US006612670B2

(12) United States Patent
Liu

(10) Patent No.: US 6,612,670 B2
(45) Date of Patent: Sep. 2, 2003

(54) ELEVATED SCREEN

(76) Inventor: Yu-An Liu, No. 34, Lane 31, Alley 647, Sec. 6, Chung-Hua Rd., Hsinchu City (TW)

( * ) Notice: Subject to any disclaimer, the term of this patent is extended or adjusted under 35 U.S.C. 154(b) by 13 days.

(21) Appl. No.: 09/838,302

(22) Filed: Apr. 20, 2001

(65) Prior Publication Data

US 2002/0021060 A1 Feb. 21, 2002

(30) Foreign Application Priority Data

Jun. 20, 2000 (TW) ..... 89210525 U

(51) Int. Cl.[7] ..... A47B 51/00

(52) U.S. Cl. ..... 312/312; 312/270.1; 312/205; 160/351

(58) Field of Search ..... 312/196, 205, 312/312, 319.5, 319.9, 319.7, 10.1, 270.1; 160/351, 135; 52/36.1, 220.7, 481.2, 239, 645, 240, 243.1, 238.1

(56) References Cited

U.S. PATENT DOCUMENTS 498,175 A * 5/1893 Lawson ..... 312/220
947,359 A * 1/1910 Toso ..... 312/312
1,829,359 A * 10/1931 Kittredge ..... 312/10.1
4,127,196 A * 11/1978 Boucher ..... 211/207
4,358,792 A * 11/1982 Domoleczny et al. ..... 348/789
4,491,872 A * 1/1985 Boldt et al. ..... 348/782
4,735,467 A * 4/1988 Wolters ..... 312/29
4,836,623 A * 6/1989 Holland ..... 312/195
5,433,046 A * 7/1995 MacQuarrie et al. ..... 52/238.1

FOREIGN PATENT DOCUMENTS

DE 3214702 A1 * 10/1983
GB 702896 * 1/1957

* cited by examiner

*Primary Examiner*—Lanna Mai
*Assistant Examiner*—Jerry Anderson
(74) *Attorney, Agent, or Firm*—Troxell Law Office PLLC

(57) ABSTRACT

The present invention is to provide an elevated screen which can be a simple screen or combined with a desk or a table. The elevated screen includes a screen base which sets a inner space in the center, and there is a elevating device in the inner space, and a rotating shaft of the elevating device is set at an outside surface of the screen base to be operated by users, and a bottom of the spacing board is connected to the elevating device in the inner space to be driven up and down by the elevating device, and a top of the spacing board forms a cover, wherein, the inner space of the screen base has various type to match the shape of the spacing board.

6 Claims, 17 Drawing Sheets

ELEVATED SCREEN

BACKGROUND OF THE INVENTION

1. Field of the Invention

The present invention relates to an improvement of screen structure, and more particularly to a flexible elevated screen which can be widely applied in working places or offices for multiple purpose.

2. Description of Related Art

According, the cost of business space is high since most of the offices locate in downtown area or high-rent area. However, for protecting privacy or keeping comfortable, screens or wall panels is wide applied to divide offices into several working areas. By ways of separation of screens, the working areas or offices can be used for several different purposes such as meeting, testing, working or examination. Generally speaking, the screens used in office areas can be classified into two categories. One of the categories is high-screen. High-screen is a screen with a height standing from ground to ceilings. However, this high-screen is not widely used today since high-screens is not convenient and not possible to get an open space without view barrier.

The other screen used in offices is semi-high-screen. Semi-high-screens divide an office into several working areas without view barrier. Usually, the semi-high-screen is installed after the desks are well settled. Hence. semi-high-screen is widely used because of its flexibility, mobility and convenience. However, semi-high-screen is lack of height variety since the height of semi-high-screen is always fixed. The height of semi-high-screen cannot be adjusted according to different application or purpose of users. The flexibility of the application of semi-high-screen is still limited. In addition, the assembly of semi-high-screen is complicated. Therefore, semi-high-screen still cannot meet the requirement of the applications for office users or family users.

Therefore, it is desirable to provide an improved method to mitigate the aforementioned problems.

SUMMARY OF THE INVENTION

The object of the present invention is to provide an elevated screen being able to adjust the height of the screen easily to meet the purposes of users for providing high flexibility and mobility in application.

Another object of the present invention is to provide an elevated screen with desktop to meet purposes of users.

The elevated screen includes a screen case having walls, at least one opening on said walls and an inner space surrounded by said walls; a spacing board being partially or wholly laid inside said inner space and being capable of moving in or out through said opening; an elevating device being mounted in said inner space for providing a driving force to move said spacing board into or out of said inner space of said base case; and a rotating shaft locating on the outside surface of said walls of said screen case for controlling the elevating device to locate the position of said spacing board; wherein at least one end of said spacing board is connected to said elevating device.

Another elevated screen of the present invention includes a screen case having walls, at least one opening on said walls of said screen case and an inner space surrounded by said walls of said screen case: a spacing board being partially or wholly laid inside said inner space and being capable of moving in or out through said opening; a first elevating device being mounted in said inner space of said screen case for providing a driving force to move said spacing board to move into or out of said inner space of said base case; a rotating shaft locating on the outside surface of said walls of said screen case for controlling the position of said spacing board; a shelf case having walls, at least one opening on said walls of said shelf case and an inner space surrounded by said walls of shelf case; a movable shelf being partially or wholly laid inside said inner space of said shelf case and being capable of moving in or out through said opening of said shelf case; and a second elevating device being mounted in said inner space for providing a driving force to move said movable shelf into or out of said inner space of said shelf case; wherein at least one wall of said shelf case is bound to one wall of said screen case laterally, at least one end of said spacing board is connected to said first elevating device, at least one end of said spacing board is connected to said first elevating device.

Another elevated screen of the present invention includes a screen case having walls, at least one opening on said walls of said screen case and an inner space surrounded by said walls of said screen case: a spacing board being partially or wholly laid inside said inner space and being capable of moving in or out through said opening; a first elevating device being mounted in said inner space of said screen case for providing a driving force to move said spacing board to move into or out of said inner space of said base case: a shelf case having walls, at least one opening on said walls of said shelf case and an inner space surrounded by said walls of shelf case; a movable shelf being partially or wholly laid inside said inner space of said shelf case and being capable of moving in or out through said opening of said shelf case; a second elevating device being mounted in said inner space for providing a driving force to move said movable shelf into or out of said inner space of said shelf case; and a rotating shalt locating on the outside surface of said walls of said shelf case for controlling the position of said spacing board and said movable shelf; wherein said shelf case is bound to said screen case laterally, at least one end of said spacing board is connected to said first elevating device, at least one end of said spacing board is connected to said first elevating device, said first elevating device is bound to said second elevating device to move said spacing board and said movable shelf together.

There is no limit for the spacing board of the present invention. Preferably, at least a display panel, an illuminating panel or a light is mounted on said spacing board. The shape of the spacing board of the present invention is not limited. Preferably, the cross-section of said spacing board of said screen case accommodated to said opening is in the shape of 'I', 'T' or 'H'. The screen base of the present invention is not limited. Preferably, the screen base is a working table or a desk. Preferably, an elevated screen of the present invention further includes at least one dust-blocking rubber attached around said opening to cover said opening. The rotating shaft of the present invention is not limited. Preferably, the rotating shaft is a manual crank rod or a rod connect to an electric motor. There is no limit for the end of the spacing board. Preferably, at least one end of said spacing board has a cap capable of covering said opening of said base case. There is no limit for the shelf of the present invention. Preferably, the surface of said shelf is mounted at least one built-in flip speaker. The shelf case is not limited. Preferably, the shelf case comprises at least one container. The style of the rotating shaft of the shelf case of the present invention is not limited. Preferably, the rotating shaft of the shelf case of the present invention is a pedal star switch or a stepping star switch. The screen case or the shelf case can combined with other device or element for multiple purposes. Preferably, at least one of the wall is bound or combined with a desk said desk comprises at least one desktop and two supporters for supporting said desktop. The shape of the supporters of the present invention is not limited. Preferably, each supporter comprises at least one track for sliding at least one keyboard plate or one drawer.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
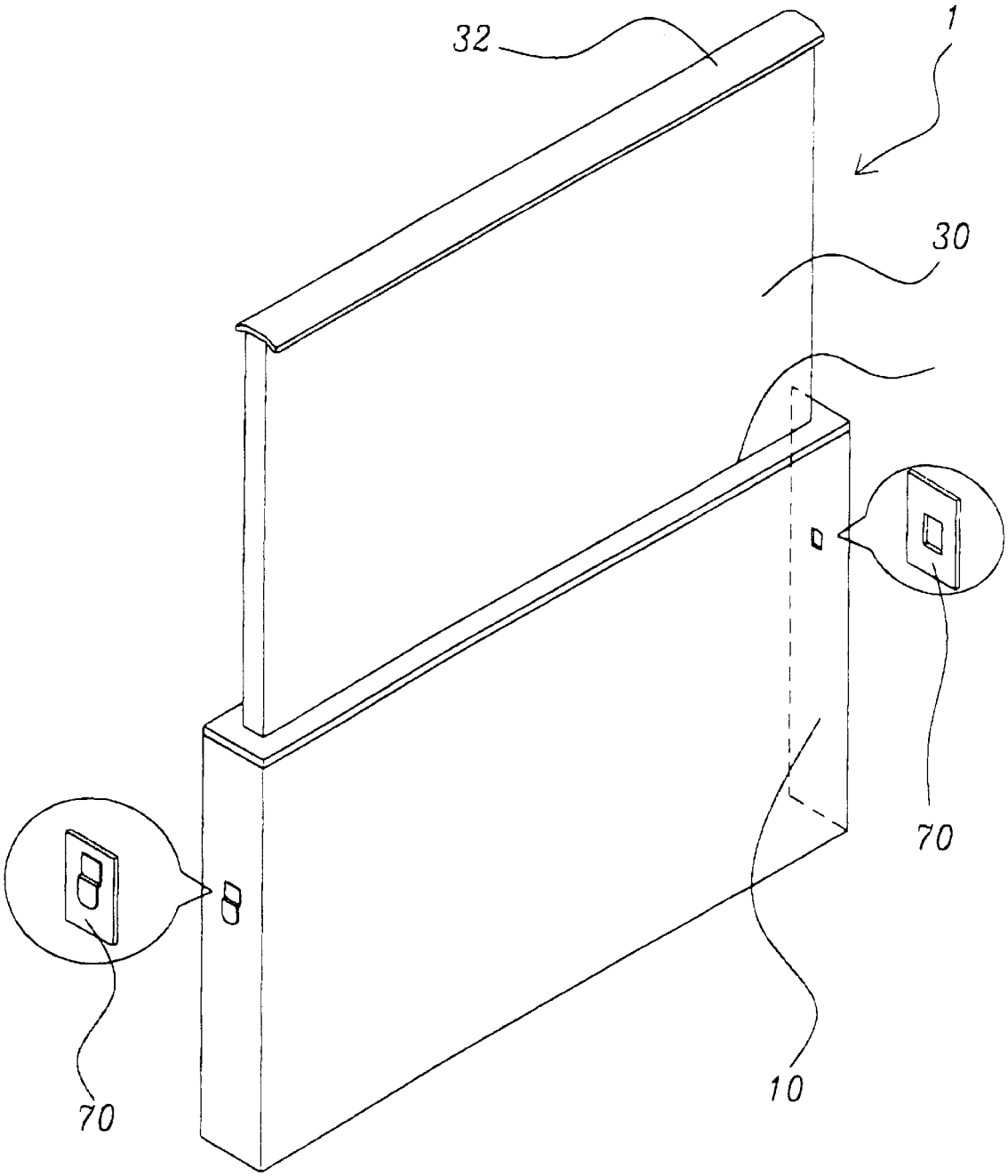
FIG. 1 is the schematic view of the embodiment of the screen of the present invention.
Figure 2:
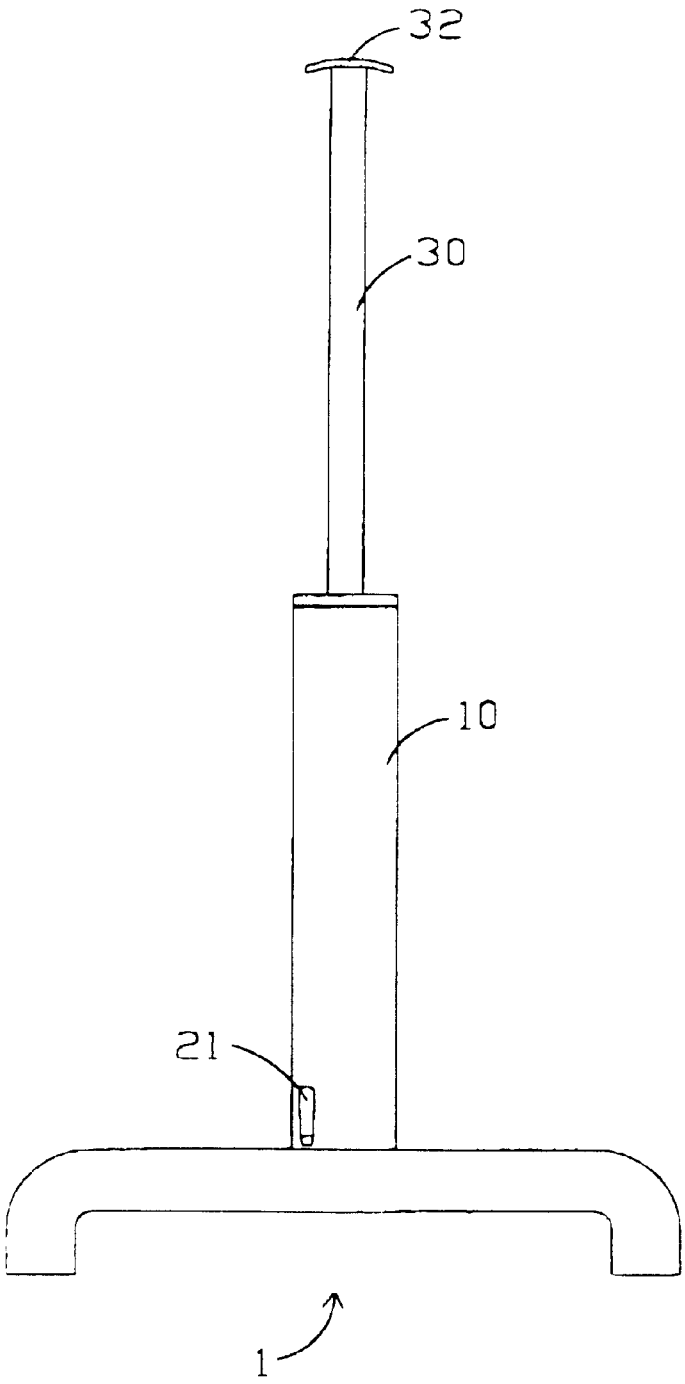
FIG. 2 is the side view of the embodiment of the screen present invention.
Figure 3:
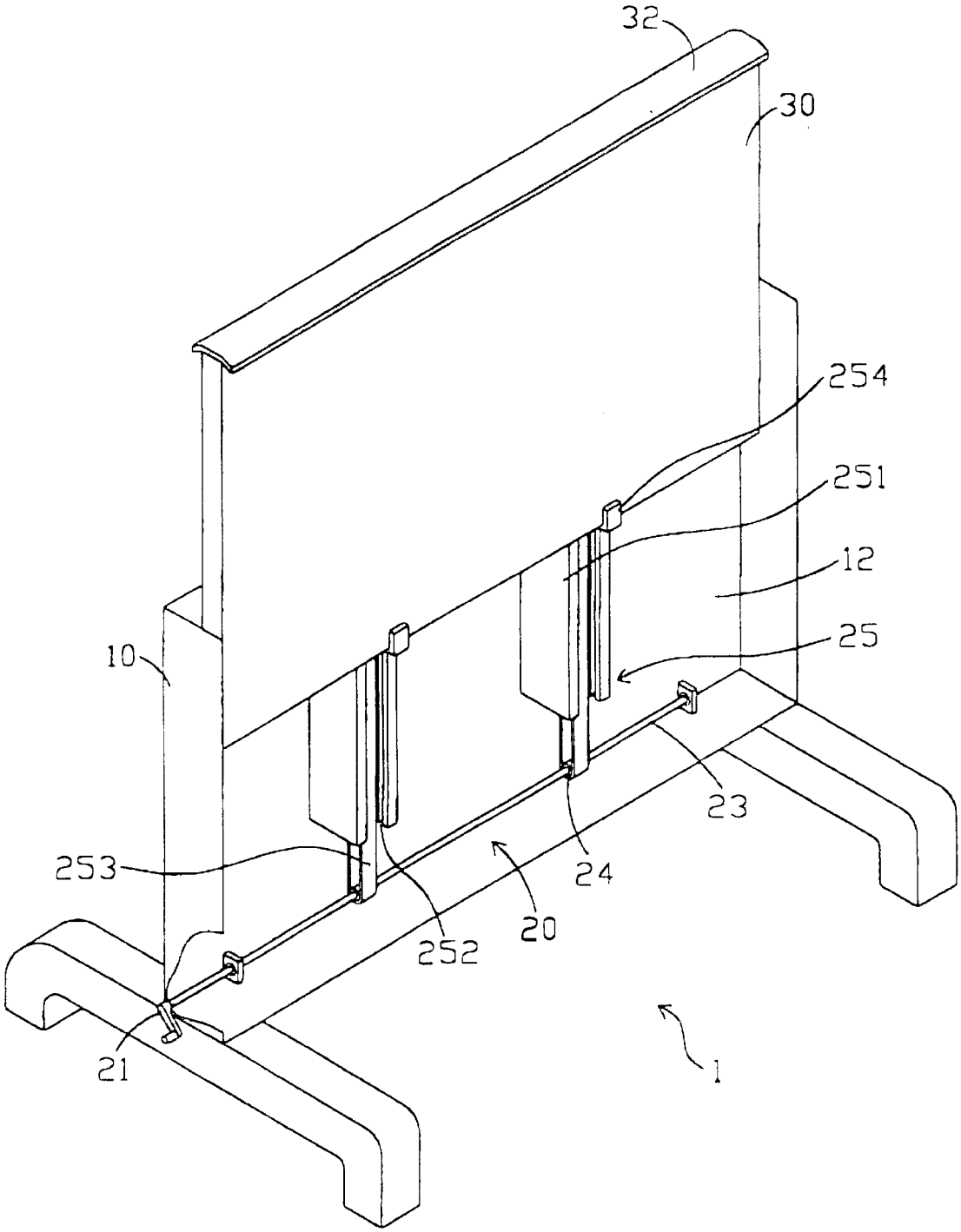
FIG. 3 is the schematic view of another embodiment of the screen of the present invention.
Figure 4:
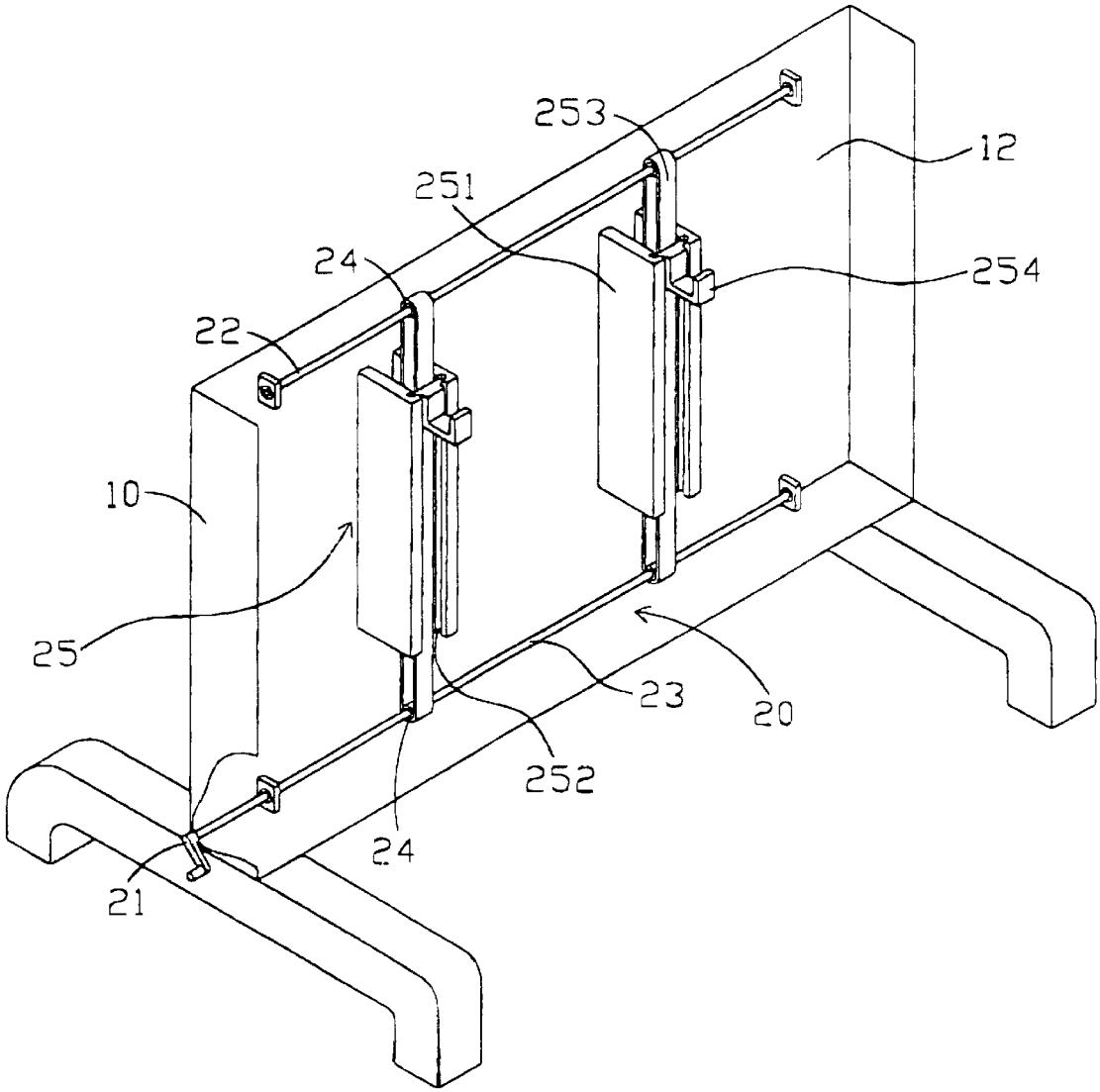
FIG. 4 is the schematic view of the elevating device of the present invention.
Figure 5:
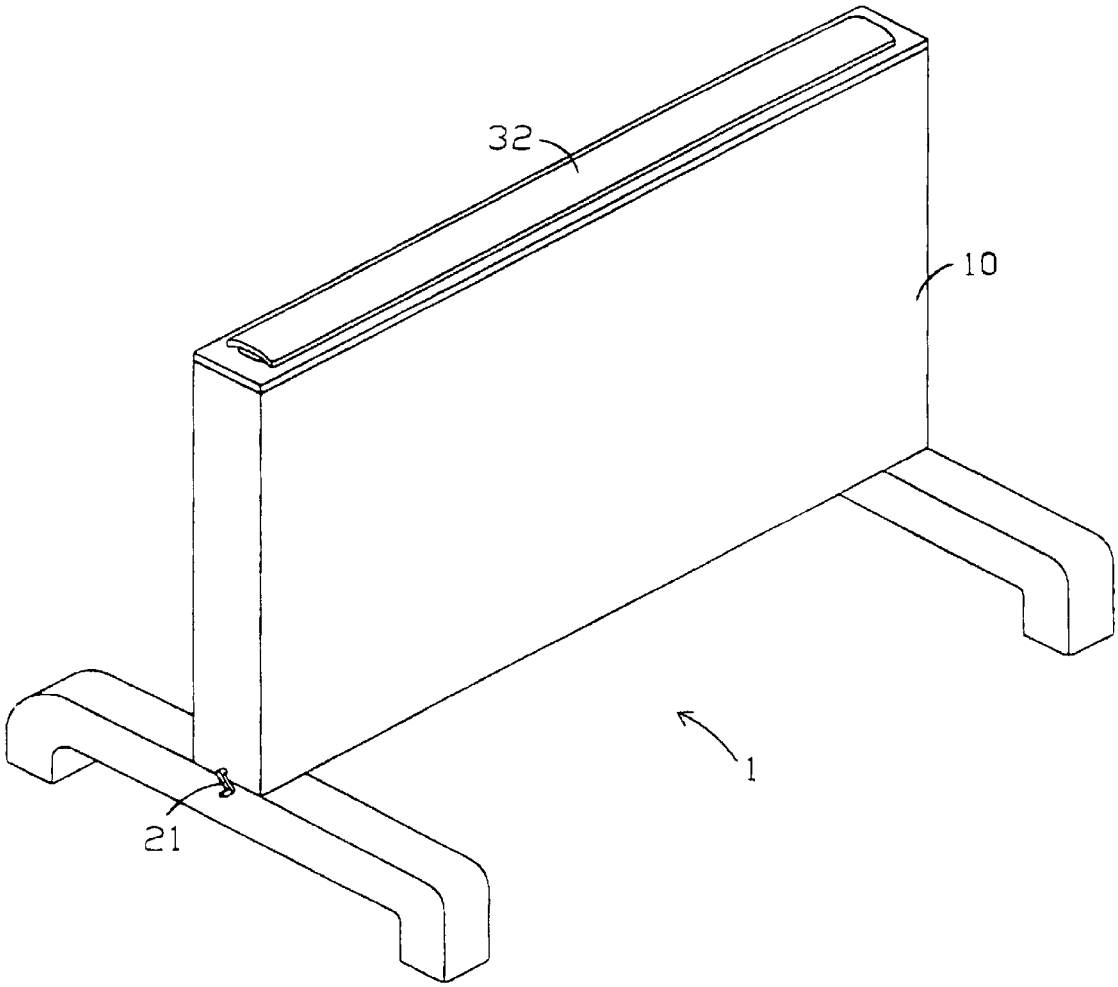
FIG. 5 is the schematic view of the un-raised spacing board of the present invention.

The feature of the present invention is to provide an elevated screen with high mobility, flexibility and humanity to adjust the height easily and conveniently. FIGS. 1–3 respectively are the schematic views and the side view of the screen of the present invention. As shown in those Figs, an elevated screen 1 is made of a screen base 10, an elevating device 20, and a spacing board 30. There is an inner space 12 in the center of the screen base 10. An elevating device 20 is placed in the inner space 12. Referring to FIG. 3 and FIG. 4, the rotating shaft of the elevating device 20 is usually a manual crank rod 21 located at the outside surface of the screen base 10. The bottom of the spacing board 30 connects to the elevating device 20 of the inner space 12. The spacing board 30 is driven up and down by the movement of the elevating device 20. On the top of the spacing board, there is an upper cover 32 to cover the gap of the opening of the inner (shown in FIG. 5) the shape and the size of the inner space 12 is usually the same with those of the spacing board 30.

Referring to FIG. 3 and FIG. 4, the mentioned elevating device 20 is set across the upper transverse rod 22 and the lower transverse rod 23 in the inside wall of the screen base's 10 inner space 12. Two rotating shafts 24 are set on the upper transverse rod 22 and the lower transverse rod 23. One end of the lower transverse rod 23 connects to a manual crank rod 21 which rotates the lower transverse rod 23. Two parallel slide assemblies 25 are located vertically on the inside walls and between the upper transverse rod 22 and the lower transverse rod 23. Each sliding assembly 25 includes two flat plates 251 parallel. At least one guiding groove 252 is located in the corresponding inner surfaces of the two flat pates 251. A transmission belt 253 is set between the rotating shafts 24. The transmission belt 253 goes through the space between two flat plates 251. In addition, a bearer 254 is embedded in the guiding groove 252 of the two flat plates 251 for moving up and down. Each bearer 254 is fixed on the transmission belt 253. When the manual crank rod 21 is driven to rotate, owing to the connection of the whole set of the lower transverse rod 23, the rotating shaft 24, the transmission belt 253, and the upper transverse rod 22, the upper transverse rod 22 will roll. Moreover, the bearer 254 on the transmission belt 253 can move up and down in the guiding groove 252. At the same time, the spacing board 30 on the supporting rack 254 will also move up and down. The elevating function of present invention can be achieved through the mechanism illustrated above.

Figure 6:
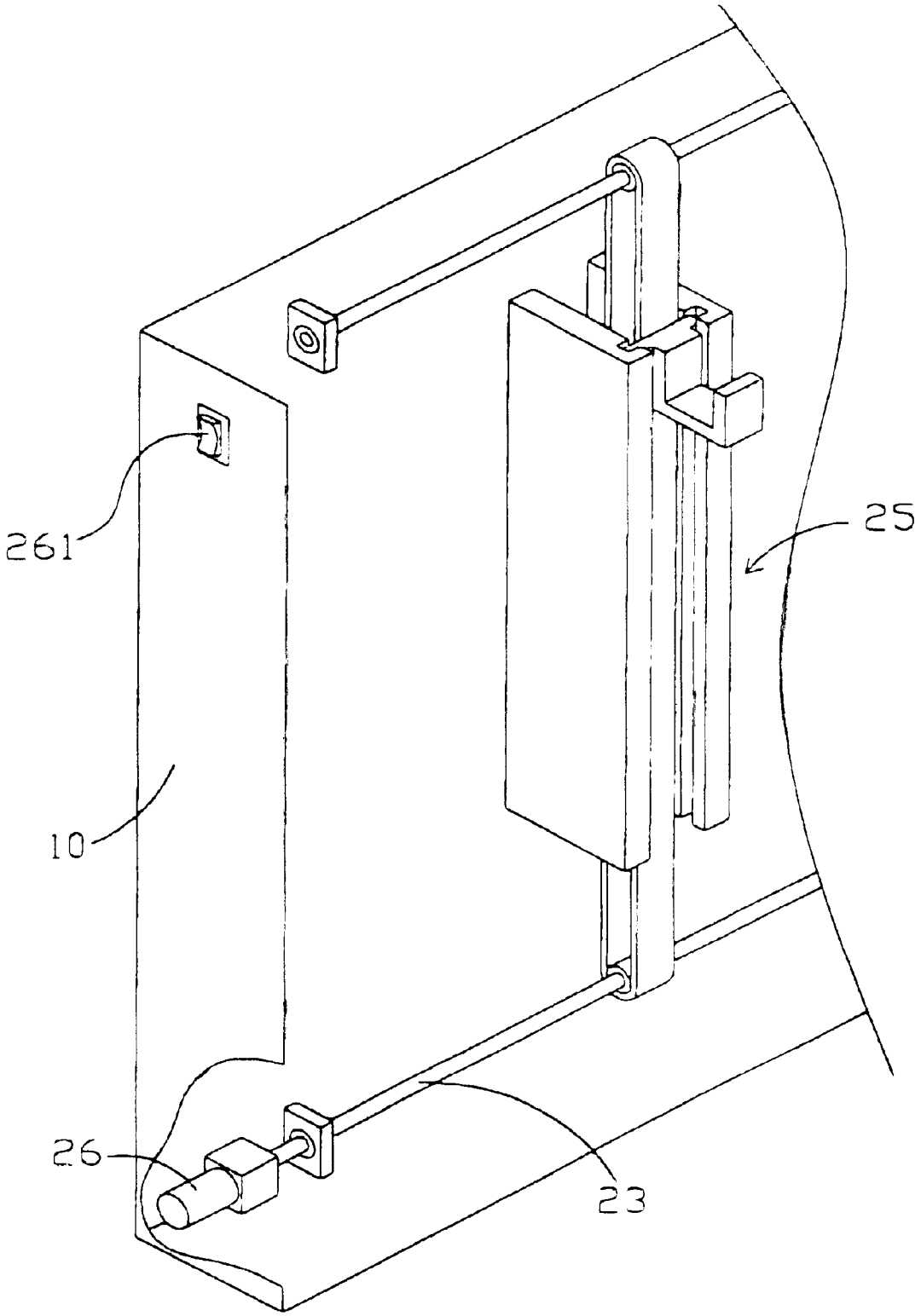
FIG. 6 is another embodiment of the rotating shaft of the screen of the present invention.

Moreover, the rotating shaft of the elevating device 20 is set on the outside surface of the screen base 10. The rotating shaft can be selectively connected to the manual crank rod 21 of the lower transverse rod 23 or the rotating shaft can be connected to an electric motor 26. The mechanism shown in FIG. 6 is an embodiment for connecting the lower transverse rod 23 to an electric motor 26 to drive the sliding assembly 25. The start switch 261 of the electric motor 26 is set on the proper position of the outside surface of the screen base 10 for the operation of users.

Furthermore, there are two blocking-dust rubber can be selectively placed (not shown) at the opening of the inner space of the screen base to avoid dust falling into the gap between the screen base and the spacing board. Thus, the negative effect caused by accumulated dusts can be prevented.

Figure 7:
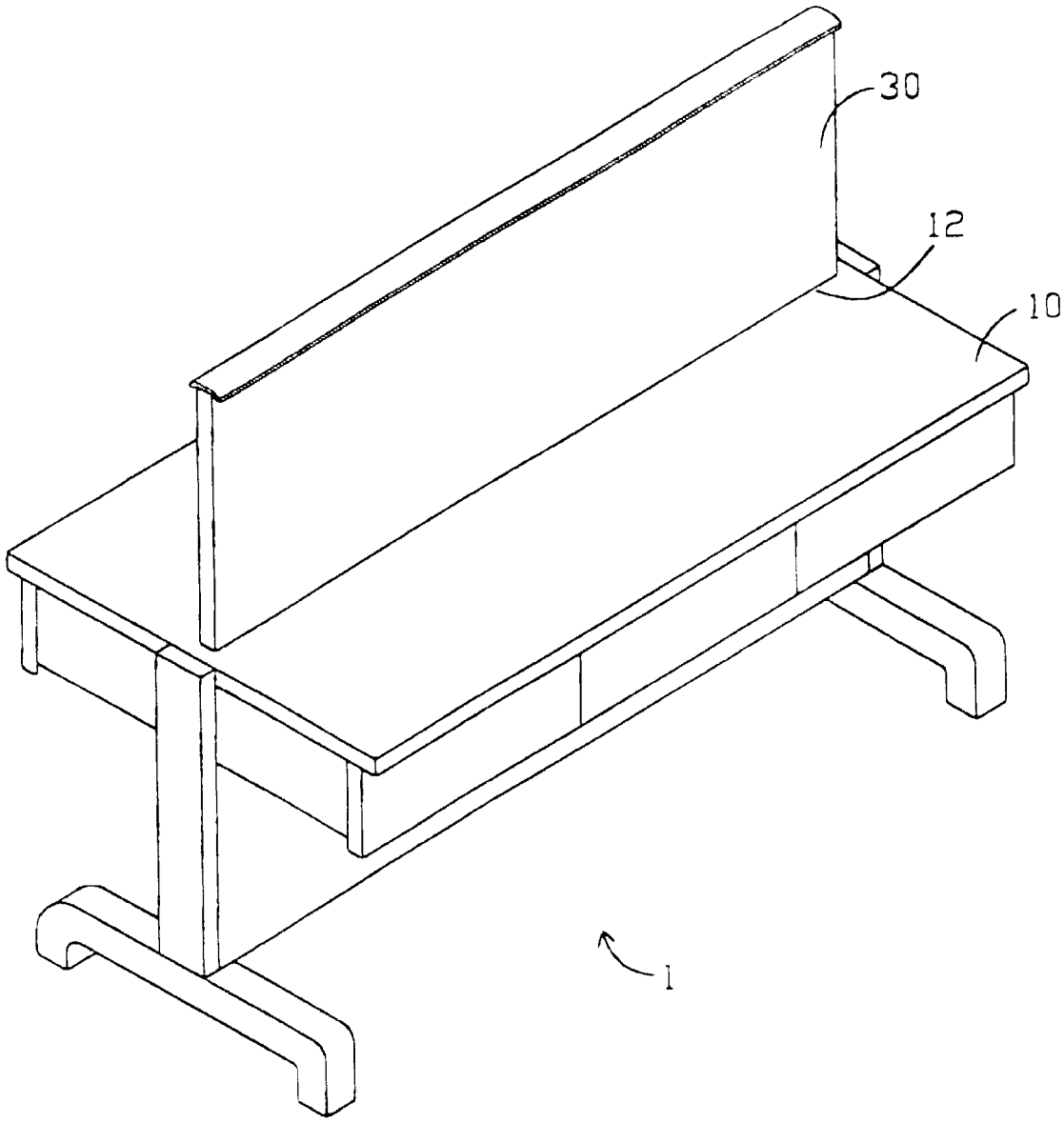
FIG. 7 is another embodiment of the present invention.
Figure 8:
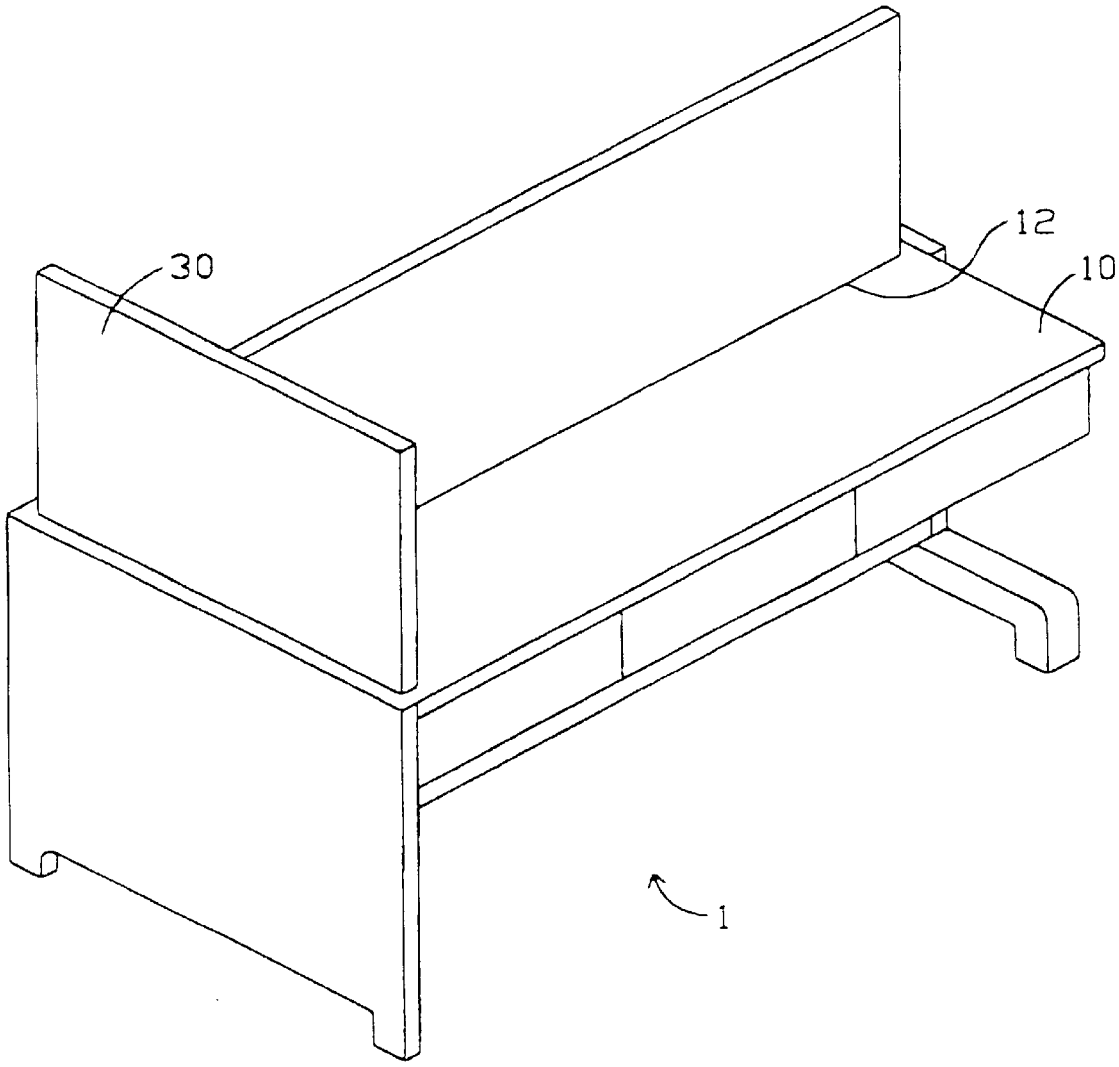
FIG. 8 is another embodiment of the present invention.
Figure 9:
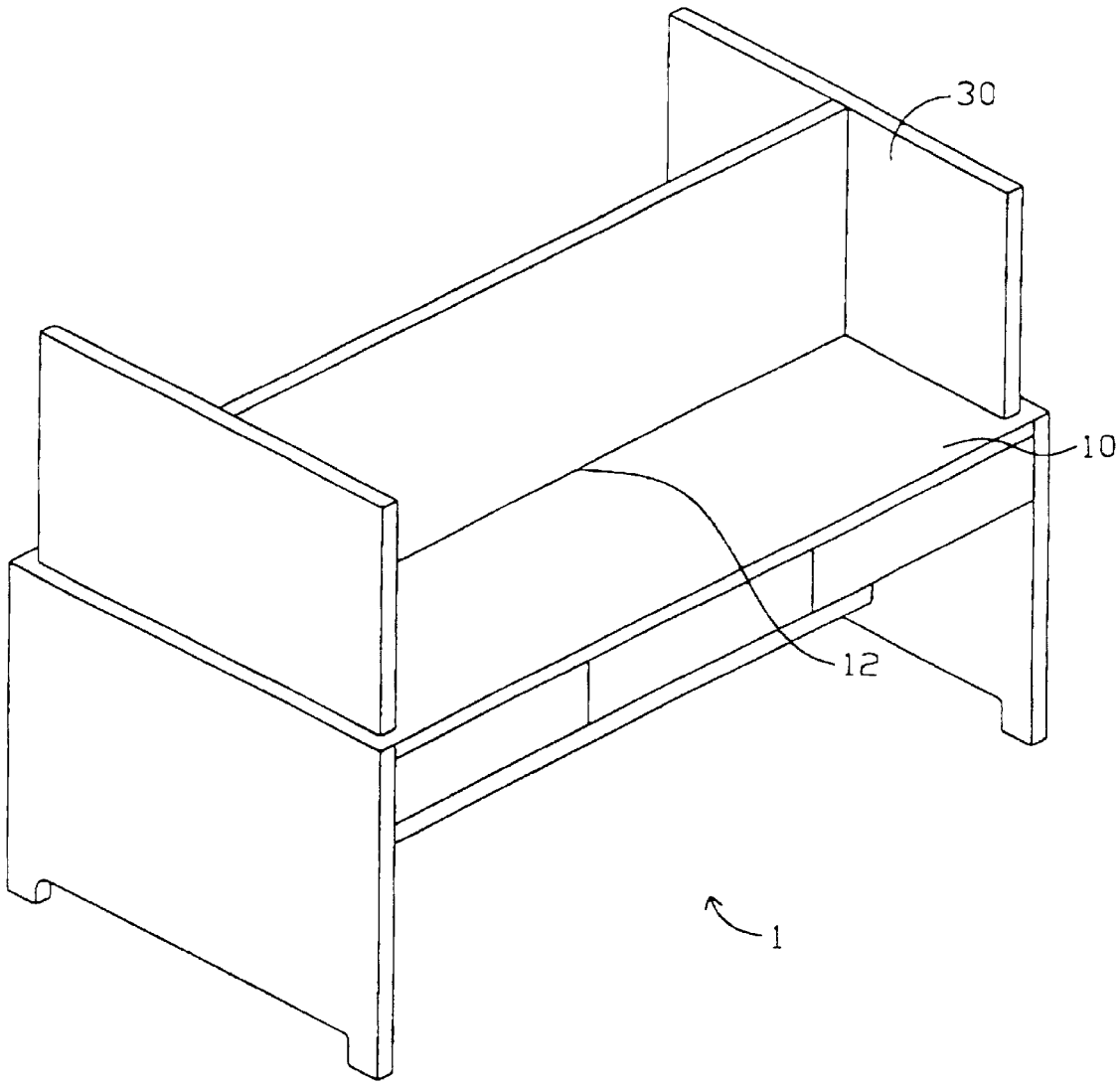
FIG. 9 is another embodiment of the present invention.

The structure of the elevated screen can be a screen base of simple screen or can be a combination of screen base and a desk. Various type of combination can be shown in FIG. 7, FIG. 8, and FIG. 9. As shown in FIG. 7 the screen base 12 of the elevated screen 1 is a desk, and the cross-section of the inner space 12 and the spacing board 30 is in the shape of 'I'. FIG. 8 shows another embodiment of the present invention. As shown in FIG. 8, the screen base 12 of the elevated screen 1 is a desk, and the cross-section of the inner space 12 and the spacing board 30 is in the shape of 'T'. FIG. 9 shows another embodiment of the present invention. As shown in FIG. 9, the screen base 12 of the elevated screen 1 is a desk, and the cross-section of the inner space 12 and the spacing board 30 is in the shape of 'H'.

The mentioned elevated screen of present invention provides a multi-functional desk to be installed and moved easily to meet many purposes such as private meeting, project discussion or group examination. The elevated screen of the present invention can make offices be an open space without partitions. The elevated screen of the present invention also can divide spaces or offices into several private working areas immediately (by changing the position or the height of the spacing board). The elevated screen of the present invention can be also applied as a counter in a bank (or used as an height-adjustable mirror in the beauty salon to facilitate talking among people. Besides, the elevated screen of the present invention can he combined with flat panel displays such as LCDs and PDPs, to transmit or recording messages or images on the panel. The elevated screen of the present invention improves the inconvenience of pasting a message note on a screen. The elevated screen of the present invention also can show photos or pictures on the mounted panels to make the space more beautiful. Furthermore, electric books or documents can be displayed on the panel to improve working efficiency.

Figure 10:
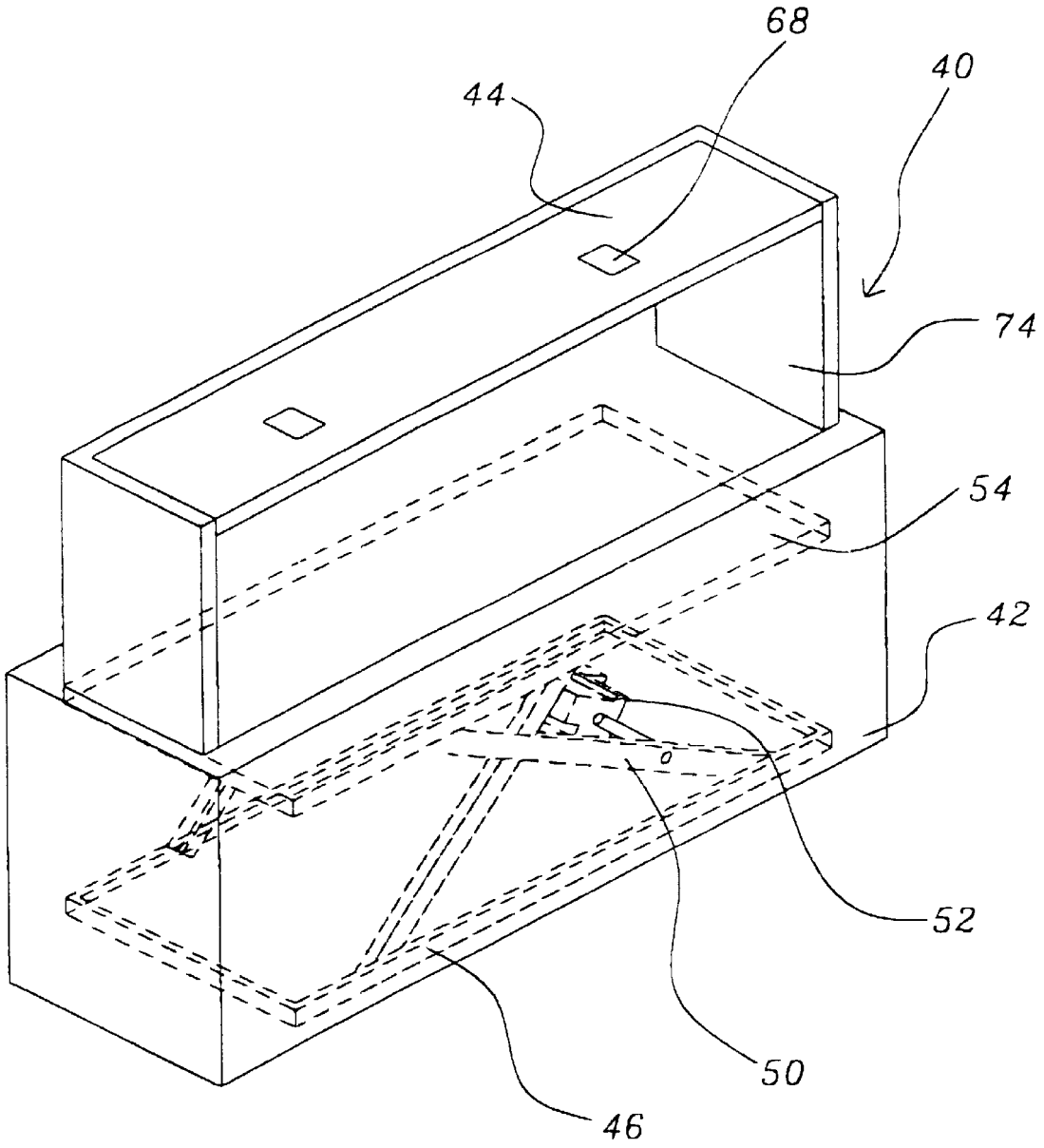
FIG. 10 is the schematic view of the self case of the present invention.

FIG. 10 shows another embodiment of the present invention. As shown in FIG. 10, the screen base 12 of the elevated screen is a shelf case 42. Inside the shelf case 42, an elevating device 46 is set. A movable shelf 44 is connected or bound to the elevating device 46. The bottom part of the movable shelf 44 is connected with the elevating device 46. On the top surface of the shelf case 42, there is an opening for allowing the movable shelf 44 to move upward or downward through the opening. The movable shelf 44 can be hidden in the shelf case 42 in the usual time. On the top surface of the movable shelf 44 which can move in or out vertically through the opening, two flipping speakers are placed. The flipping speakers can flip out of the top surface of the moving shelf as they are pushed. The elevating device in the shelf case includes two set of crossed supporters. The supporters 50 support a plate 54. The plate connects to the bottom of the shelf. The supporters are driven by a oil-pressured apparatus 52. The oil pressure apparatus 52 is fixed on one of the supporters. As the supporter is driven by the oil-pressure apparatus, the plate 54 or the shelf 44 will moved up or down. The position can be decided by the rotating shaft which will control the operation of the oil-pressure apparatus. The height of the shelf case in this embodiment is as high as that of tables or desks.

Figure 11:
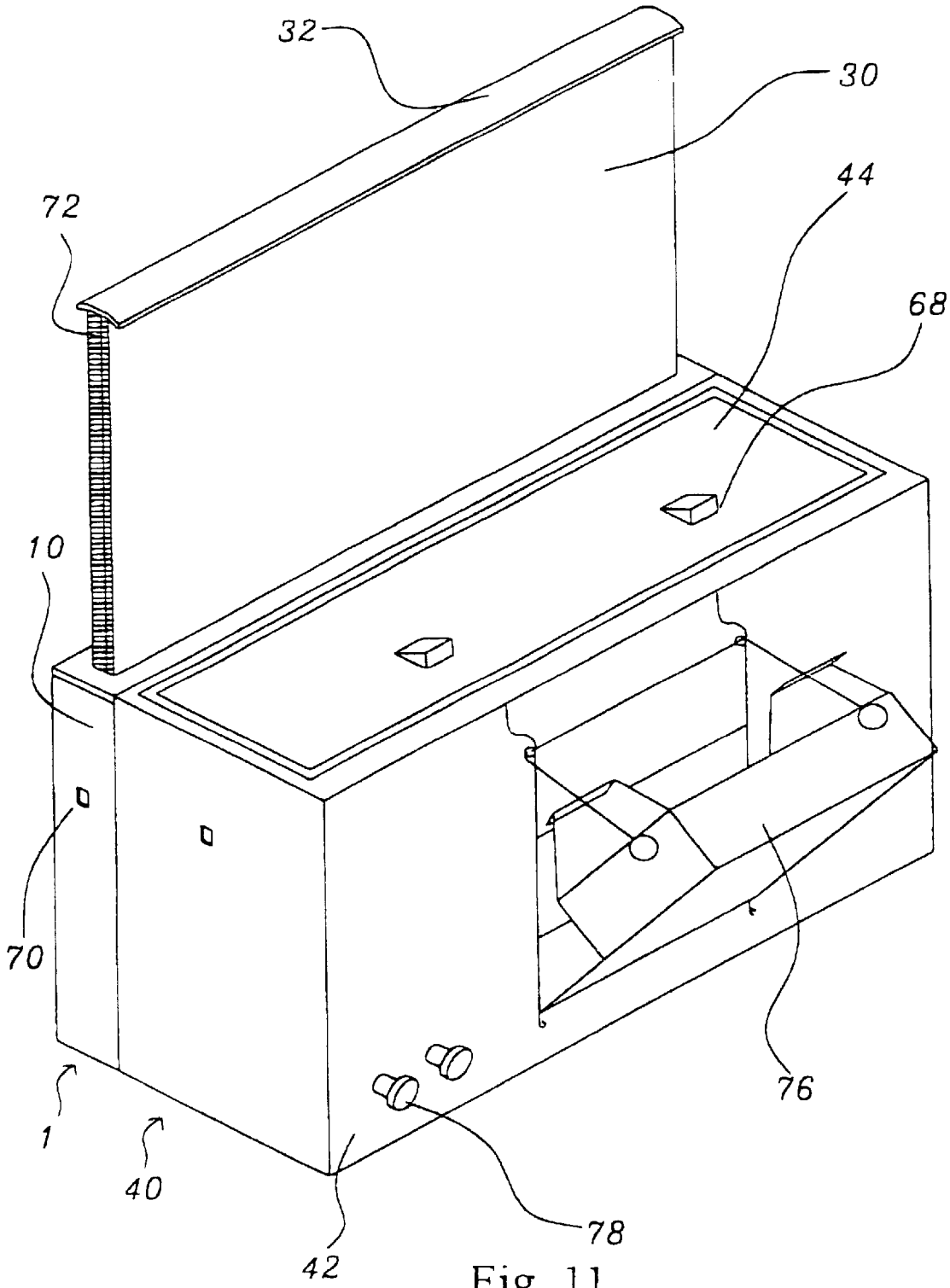
FIG. 11 is the schematic view of the shelf case of the present invention.

Another embodiment of the screen of the present invention is shown in FIG. 11. The screen case 10 is combined with a shelf case 42. This combination is much more stable. A shelf 44 is set inside the shelf case 42. The elevating device of the shelf 44 can be combined or connected with the elevating device of the elevated screen 32. The positions of the shelf or the screen can be controlled through the rotating shaft at the same time. The inner space of the shelf can be further divided into several spaces. The way of the space separation can be decided by the purposes of users. Furthermore, the surface of the screen can be placed at least one brush to prevent from any noise. The shelf case can further includes a small case 76 or a drawer for storing materials (e.g. recycled paper). The small case 76 can be arranged as shown in FIG. 11 to FIG. 17.

Figure 12:
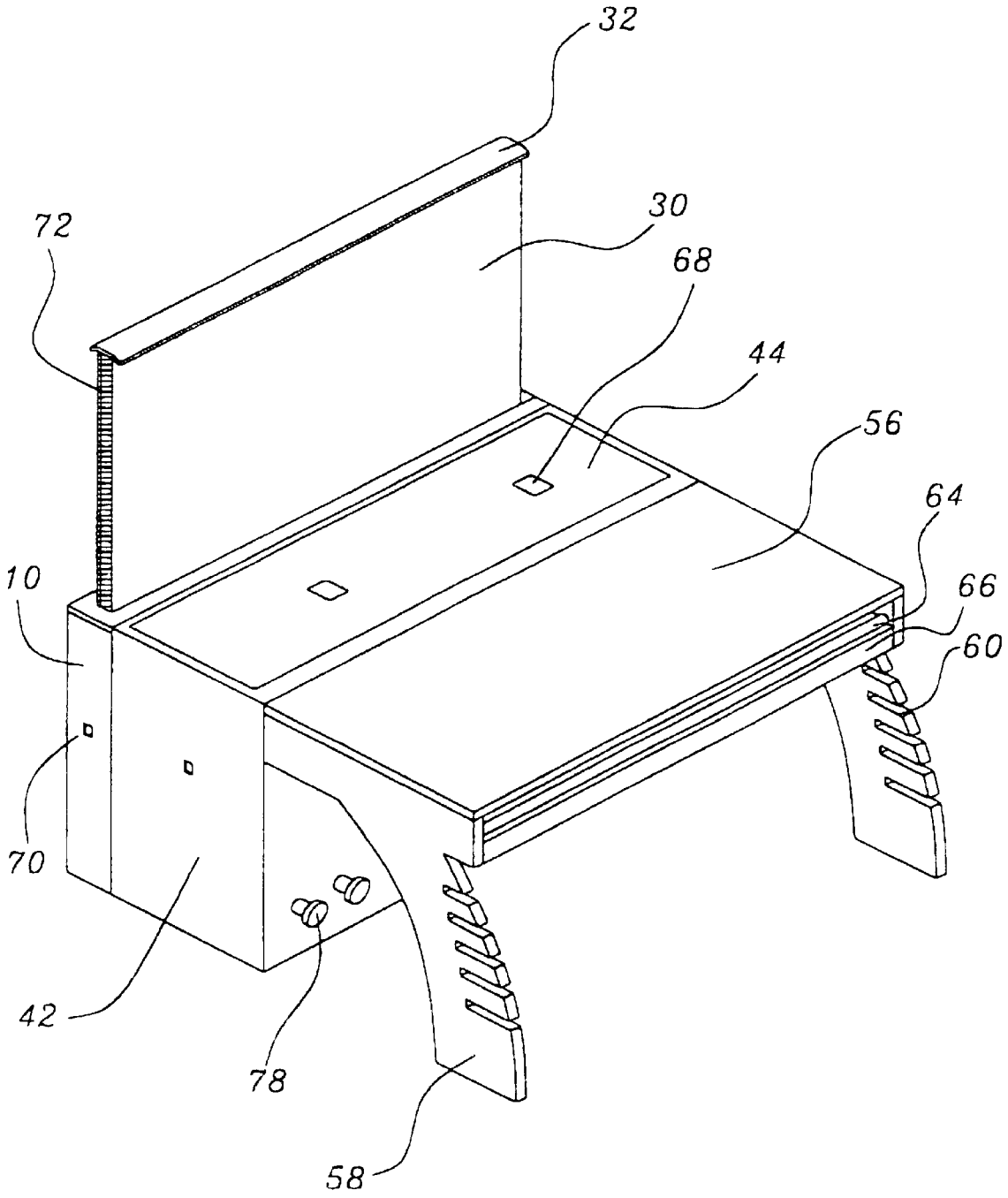
FIG. 12 is another embodiment of the present invention.
Figure 13:
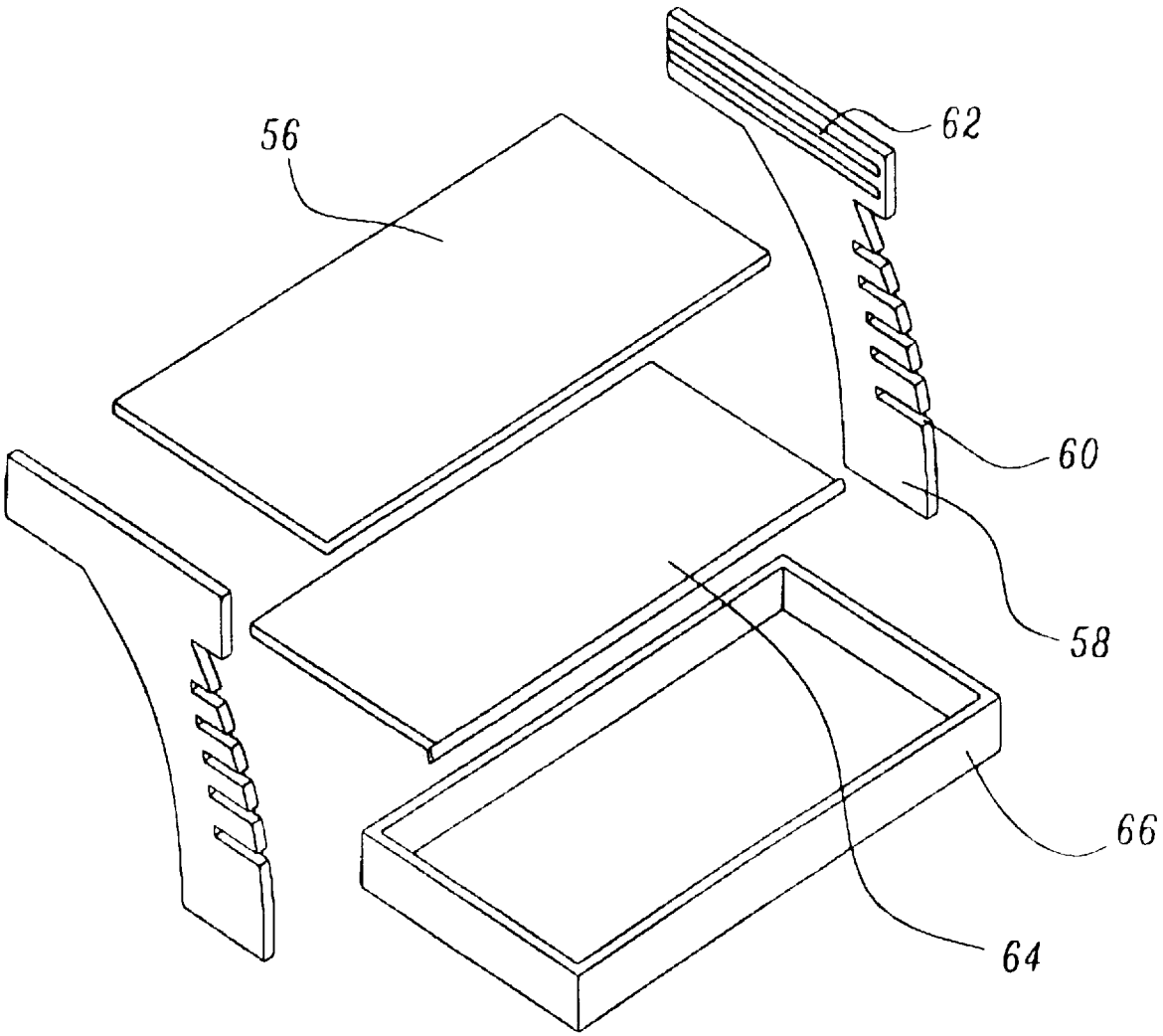
FIG. 13 is the exploded view of FIG. 12.
Figure 14:
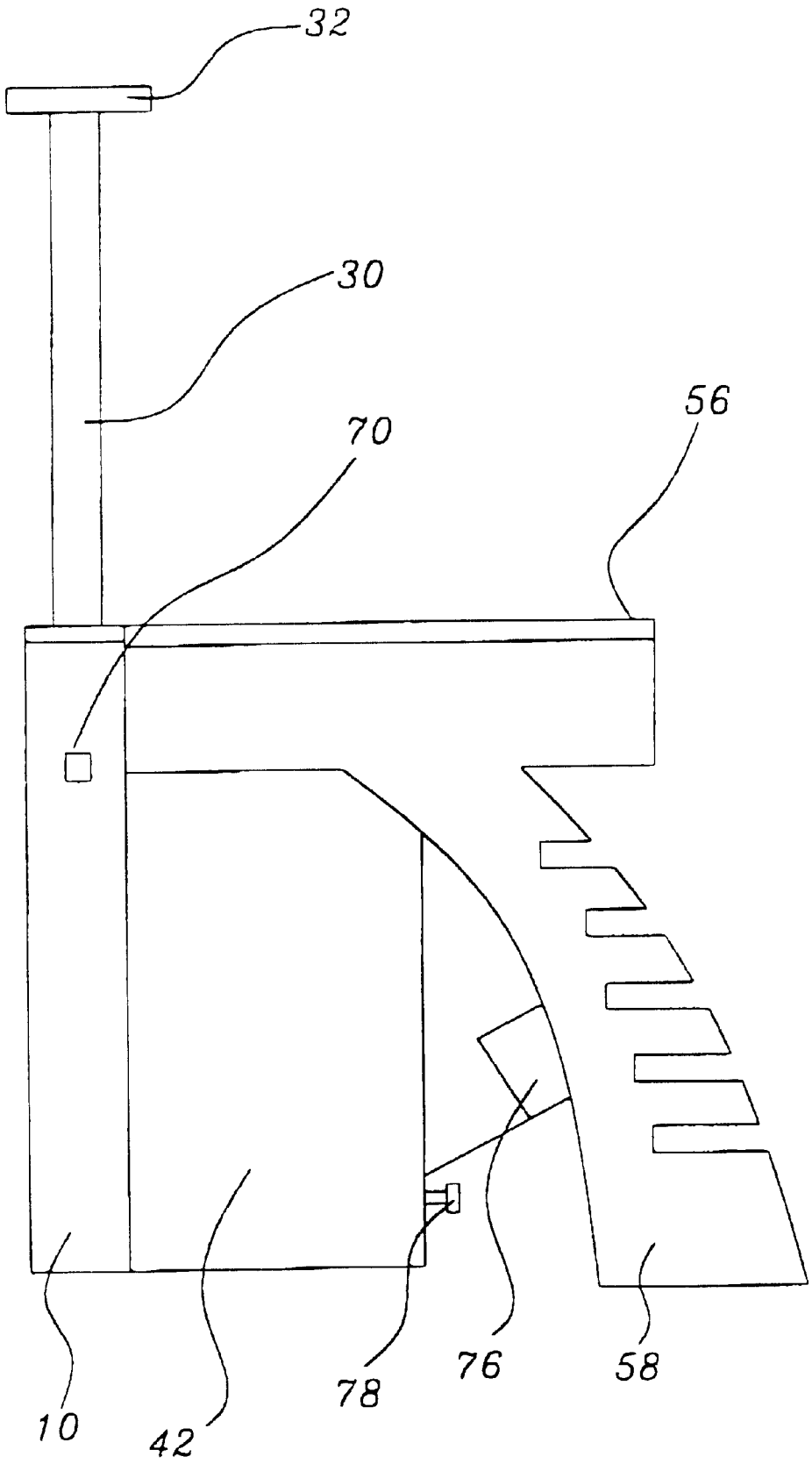
FIG. 14 is the side view of another embodiment of the present invention.
Figure 15:
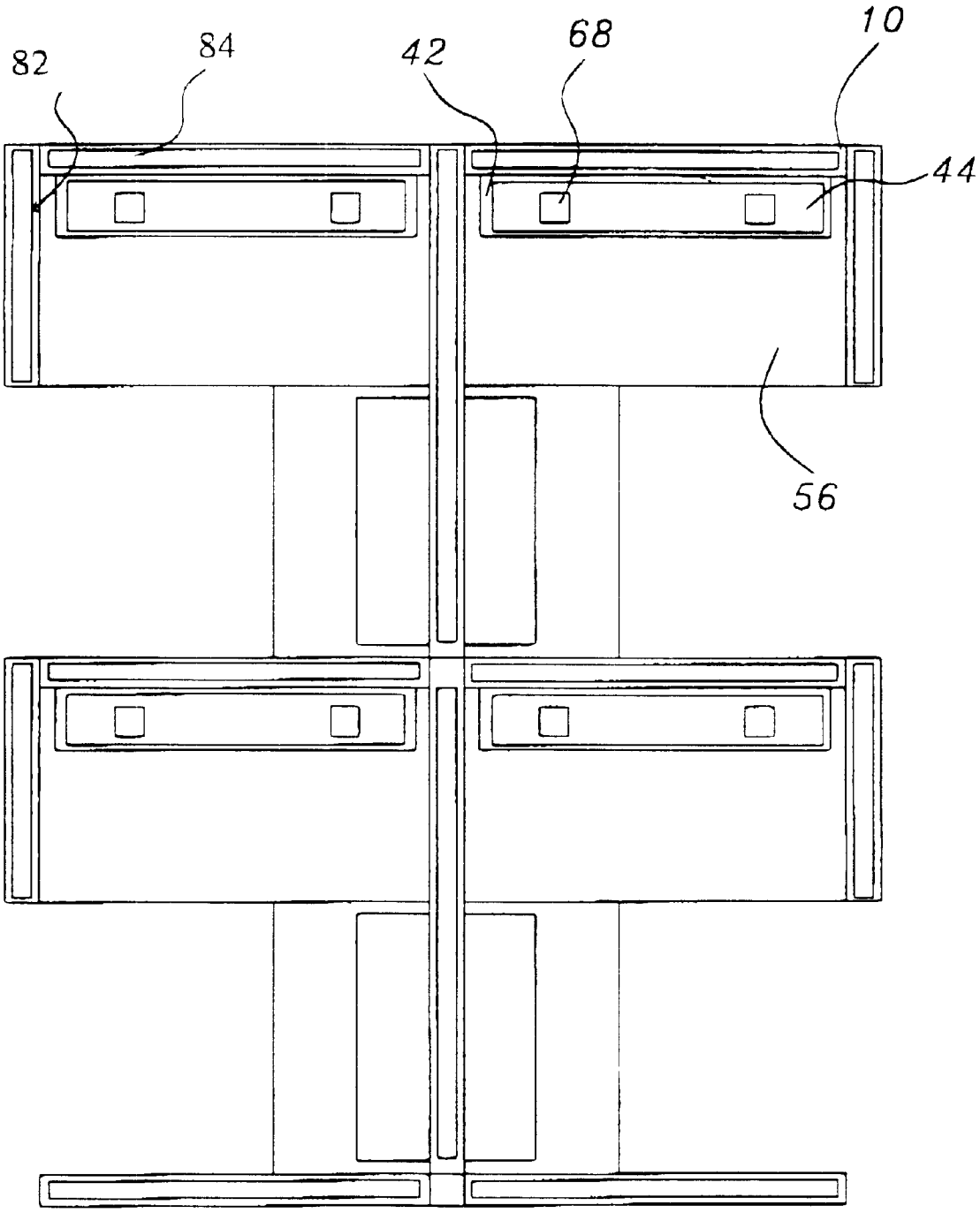
FIG. 15 is the vertical view of another embodiment of the present invention.

The height of the shelf case 42 is not limited. Preferably, the shelf case is as high as conventional desks or tables are. Therefore, as the shelf case is used as a working table, the space below the desktop of the shelf case can be well used. The desktop of the shelf case can keep clean or clear. Referring to FIG. 12 and FIG. 13, the shelf case can be attached or combined with a table or a desk 56 with the same height of the shelf case 42. The combined table 56 is supported by two supporters 58 which is in a shape of "7". In addition, the supporters 58 can be cut to form several guiding grooves 60 to hold disks. The top part of each supporter 60 is mounted at least one guiding groove. The guiding grooves 60 are design for setting a drawer 66 or a plate 64 for placing computer keyboards to slide in under the desktop of the table 56. Furthermore, two flipping-speakers 68 are mounted on the top surface of the shelf 44. A panel for display and lighting is mounted on the screen 30 for transmitting images or messages. The details of the screen which is combined with a table can be seen in FIG. 14.

Figure 16:
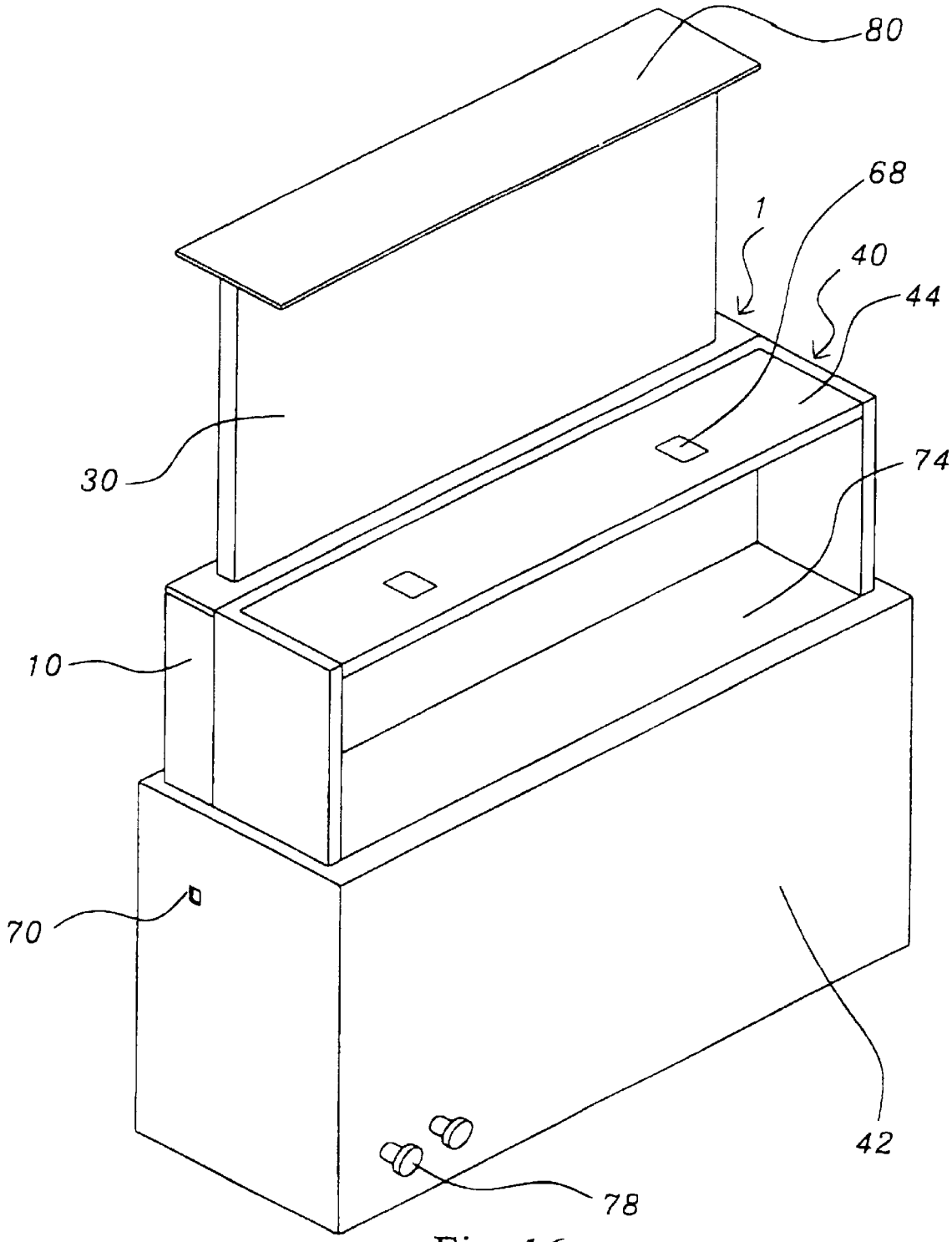
FIG. 16 is still another embodiment of the present invention.
Figure 17:
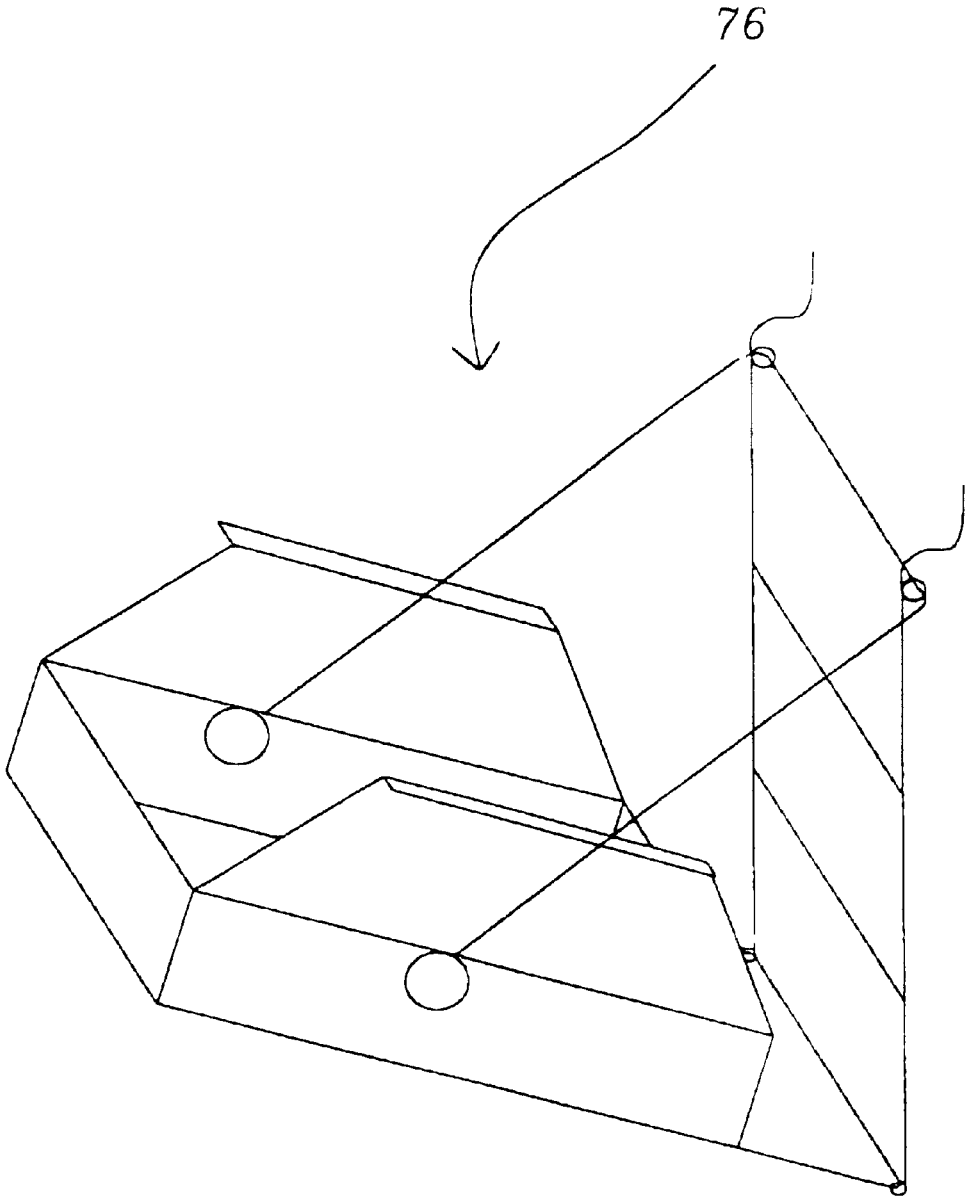
FIG. 17 is the detail of the container.

The elevating devices in the screen base and the shelf case can be connected through a connector 70 to be combined together. Then the screen 30 and the shelf can be moved in the same direction (e.g. upward) together. Besides, the number of the combined elevating devices is not limited. Multiple screens and shelves of different elevated screens can be combined together to move together. Then the positions of several screens of different screen cases in an office can be controlled or set at the same time. The details of the set combined elevated screens can be seen in FIG. 15. Another embodiment of the screen case of the present invention is shown in FIG. 16. The screen base 10 is combined with the shelf 44. The screen base 10 will move as the shelf 44 moves. On the top of the screen, there is mounted an storing plate for putting things for convenience. The combined screen shown in FIG. 16 is much stable and has more spaces to store materials.

Although the present invention has been explained in relation to its preferred embodiment, it is to be understood that many other possible modifications and variations can be made without departing from the spirit and scope of the invention as hereinafter claimed.

What is claimed is:

1. An extendable partition screen comprising:

a) an elongated planar base oriented in a vertical direction, the base bounding an inner space with an upper facing opening;

b) upper and lower elongated, spaced apart, transverse rods rotatably located in the inner space;

c) two spaced apart slide assemblies located within the inner space, each slide assembly including: a transmission belt extending around and driven by rotation of the upper and lower transverse rods; and a bearer extending from the drive belt, the bearer slidably mounted between spaced apart plates; and, d) a spacing board extending substantially across an entire width of the elongated base, the spacing board mounted on the bearers of the slide assemblies whereby rotation of one of the elongated transverse rods moves the spacing board between a retracted position wherein the spacing board is located substantially entirely within the inner space, and an extended position in which the spacing board extends from the base through the upper facing opening.

2. The extendable partition screen of claim 1 further comprising a drive mechanism connected to the lower transverse rod.

3. The extendable partition screen of claim 2 wherein the drive mechanism comprises a manual crank located exteriorly of the base.

4. The extendable partition screen of claim 1 wherein the bearers each have a U-shaped configuration.

5. The extendable partition screen of claim 1 further comprising an upper cover attached to the partition screen so as to cover the upper facing opening when the screen partition is in the retracted position.

6. The extendable partition screen of claim 1 wherein the drive mechanism comprises an electric motor located within the inner space.

* * * * *